US011003126B2

(12) United States Patent
Sakai et al.

(10) Patent No.: US 11,003,126 B2
(45) Date of Patent: May 11, 2021

(54) WASTE POWDER RECOVERY DEVICE AND IMAGE FORMING DEVICE

(71) Applicant: FUJI XEROX CO., LTD., Tokyo (JP)

(72) Inventors: Yusuke Sakai, Kanagawa (JP); Hirohisa Hoshino, Kanagawa (JP); Tadashi Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/817,942

(22) Filed: Mar. 13, 2020

(65) Prior Publication Data

US 2021/0088961 A1 Mar. 25, 2021

(30) Foreign Application Priority Data

Sep. 20, 2019 (JP) ..... JP2019-171265

(51) Int. Cl.

*G03G 21/10* (2006.01)
*G03G 15/08* (2006.01)
*G03G 21/12* (2006.01)

(52) U.S. Cl.

CPC ..... *G03G 21/105* (2013.01); *G03G 15/0891* (2013.01); *G03G 21/12* (2013.01); *G03G 2215/0827* (2013.01)

(58) Field of Classification Search

CPC ..... G03G 21/10; G03G 21/12; G03G 21/105; G03G 2215/0827; G03G 2215/0833

See application file for complete search history.

(56) References Cited

U.S. PATENT DOCUMENTS

2009/0136266 A1* 5/2009 Ichikawa ..... G03G 15/0886 399/263
2010/0119270 A1* 5/2010 Hoshino ..... G03G 21/105 399/358
2014/0010579 A1* 1/2014 Yoshino ..... G03G 21/105 399/358

FOREIGN PATENT DOCUMENTS

JP 2008-112193 A 5/2008

* cited by examiner

*Primary Examiner* — Thomas S Giampaolo, II
(74) *Attorney, Agent, or Firm* — Sughrue Mion, PLLC

(57) ABSTRACT

A waste powder recovery device includes: a recovery container that houses waste powder and has an inlet through which the waste powder is received; and a conveying component that is cantilever-supported in such a way as to swing freely inside the recovery container, the conveying component having a first conveying section with which the waste powder brought in through the inlet is conveyed with a first conveying force within the recovery container, and a second conveying section with which the waste powder is conveyed with a second conveying force that is larger than the first conveying force.

20 Claims, 15 Drawing Sheets

WASTE POWDER RECOVERY DEVICE AND IMAGE FORMING DEVICE

CROSS-REFERENCE TO RELATED APPLICATIONS

This application is based on and claims priority under 35 USC 119 from Japanese Patent Application No. 2019-171265 filed Sep. 20, 2019.

BACKGROUND

(i) Technical Field

The present disclosure relates to a waste powder recovery device and an image forming device.

(ii) Related Art

There is a known waste toner recovery box that is mounted in an image forming device and recovers and stores waste toner including used toner and/or developer discharged from the image forming device (Japanese Unexamined Patent Application Publication No. 2008-112193). The waste toner recovery box is configured of: a box main body that has multiple waste toner recovery openings formed therein, and stores, in an internal space, waste toner that has dropped in from the recovery openings; and a pair of conveying members that are provided along an upper housing limit for the waste toner in the box main body and parallel to each other along the recovery openings, and that are rotationally driven and convey, within the box main body, the waste toner that has dropped in from the recovery openings due to the rotation. The pair of conveying members have different conveying directions for the waste toner in the box main body.

SUMMARY

Aspects of non-limiting embodiments of the present disclosure relate to a waste powder recovery device and an image forming device with which waste powder may be efficiently deposited within a recovery container due to waste powder inside the waste powder recovery device being piled up to the upper surface of the container.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a waste powder recovery device including: a recovery container that houses waste powder and has an inlet through which the waste powder is received; and a conveying component that is cantilever-supported in such a way as to swing freely inside the recovery container, the conveying component having a first conveying section with which the waste powder brought in through the inlet is conveyed with a first conveying force within the recovery container, and a second conveying section with which the waste powder is conveyed with a second conveying force that is larger than the first conveying force.

BRIEF DESCRIPTION OF THE DRAWINGS

An exemplary embodiment of the present disclosure will be described in detail based on the following figures, wherein.

DETAILED DESCRIPTION

Figure 1:
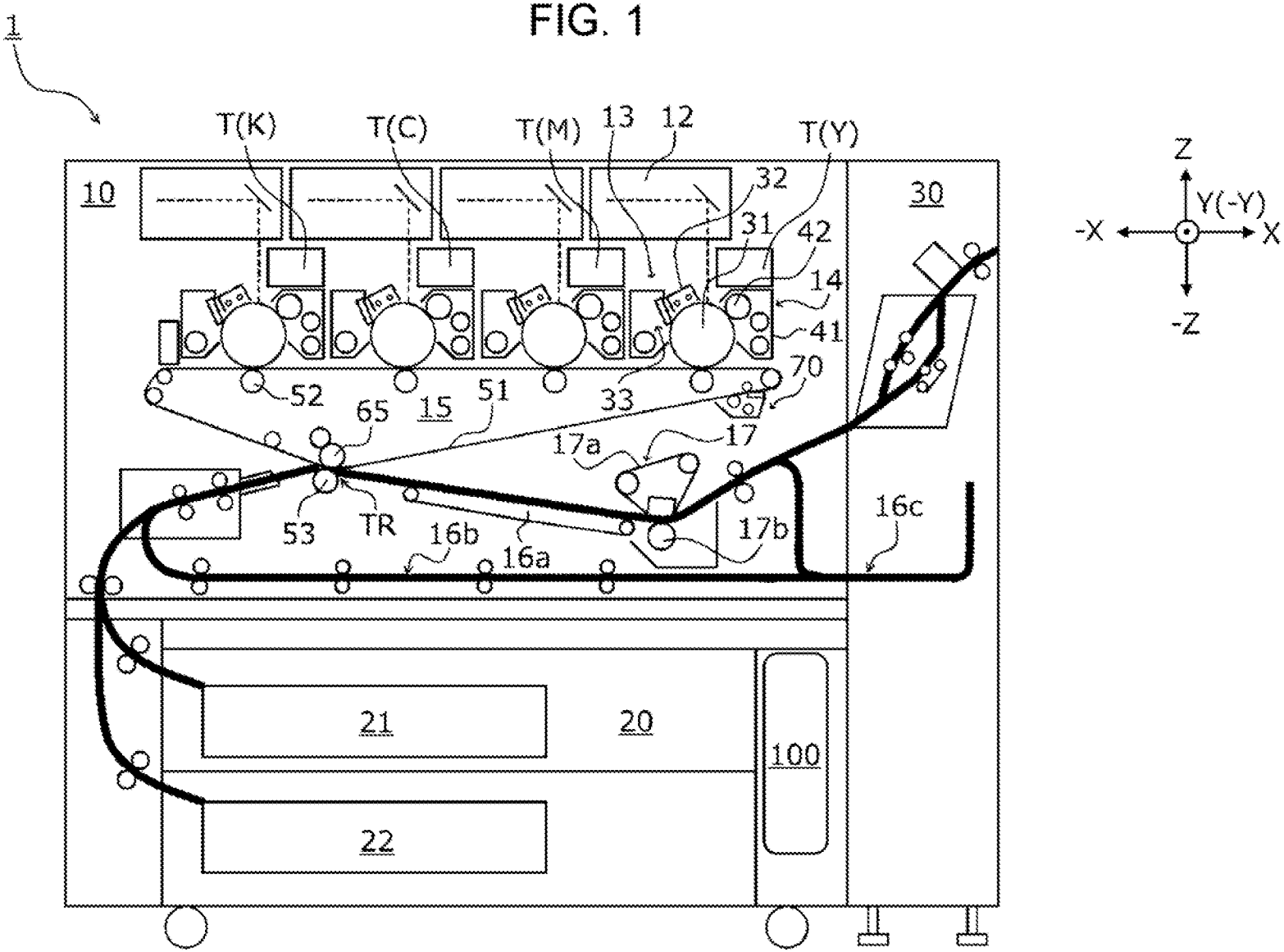
FIG. 1 is a cross-sectional schematic view depicting an example of the schematic configuration of an image forming device.

Next, with reference to the drawings, an exemplary embodiment and specific examples will be given hereinafter for the present disclosure to be described in greater detail; however, the present disclosure is not restricted to the exemplary embodiment and specific examples.

Furthermore, in the description using the drawings hereinafter, please be aware that the drawings are schematic and the ratios of the dimensions and so forth are different from those in reality, and members other than those required for the description are not depicted as appropriate to aid understanding.

It should be noted that, to facilitate understanding of the description given hereinafter, in the drawings, the front-rear direction is the X axis direction, the left-right direction is the Y axis direction, and the up-down direction is the Z axis direction.

(1) Overall Configuration and Operation of Image Forming Device (1.1) Overall Configuration of Image Forming Device FIG. 1 is a cross-sectional schematic view depicting an example of the schematic configuration of an image forming device 1 according to the present exemplary embodiment.

The image forming device 1 is provided with: an image forming unit 10; a paper feeding device 20 mounted below the image forming unit 10; and a paper output unit 30 provided at one end of the image forming unit 10 and from which printed paper is output.

The image forming unit 10 is configured including a system control device (not depicted), exposure devices 12, photoconductor units 13 and developing devices 14 serving as image forming components, a transfer device 15, paper conveying devices 16*a*, 16*b*, and 16*c*, and a fixing device 17, and forms toner images on a recording medium that is fed from the paper feeding device 20.

The paper feeding device 20 supplies the recording medium to the image forming unit 10. In other words, the paper feeding device 20 is provided with multiple paper loading units 21 and 22 that house recording mediums of different types (materials, thicknesses, paper sizes, and grain directions, for example), and is configured to supply the image forming unit 10 with a recording medium fed out from either one of the multiple paper loading units 21 and 22.

The paper output unit 30 outputs a recording medium onto which an image has been output in the image forming unit 10. Therefore, the paper output unit 30 is provided with an output paper housing unit onto which the recording medium is output after an image has been output thereon. It should be noted that the paper output unit 30 may have a function of carrying out post-processing such as cutting and stapling (needle binding) with respect to a paper bundle that is output from the image forming unit 10.

(1.2) Configuration and Operation of Image Forming Unit

In the image forming device 1 having this kind of configuration, a recording medium is fed to the image forming unit 10 in accordance with the image forming timing, the recording medium being fed out from the paper loading unit 21 or 22 which is designated for each sheet of printing according to the print job from among the paper loading units 21 and 22.

The photoconductor units 13 (Y, M, C, K; hereinafter, referred to simply as a photoconductor unit 13 when it is not necessary to distinguish therebetween) are respectively disposed in parallel below the exposure devices 12 and are provided with rotationally driven photoconductor drums 31. A charger 32, an exposure device 12, a developing device 14, a first transfer roller 52, and a cleaning device 33 are arranged in the rotation direction of each photoconductor drum 31.

The developing devices 14 have a developing housing 41 that houses developer therein. In the developing housing 41, a developing roller 42 is arranged opposing the photoconductor drum 31. Developer of a regulated thickness is supplied to the developing roller 42 and a toner image is formed on the photoconductor drum 31.

The respective developing devices 14 (Y, M, C, K; hereinafter, referred to simply as a developing device 14 when it is not necessary to distinguish therebetween) are configured in a substantially similar manner apart from the developer housed in the developing housing 41, and respectively form yellow (Y), magenta (M), cyan (C), and black (B) toner images.

Exchangeable toner cartridges T that house developer (toner including carrier) are mounted above the developing devices 14. Toner cartridge guides (not depicted) that supply developer from the respective toner cartridges T (Y, M, C, K) to the developing devices 14 are arranged.

The surfaces of the rotating photoconductor drums 31 are charged by the chargers 32, and electrostatic latent images are formed by latent image-forming light emitted from the exposure devices 12. The electrostatic latent images formed on the photoconductor drums 31 are developed as toner images by the developing rollers 42.

The transfer device 15 is provided with: an intermediate transfer belt 51 serving as an image holder that carries out the multiple transfer of color toner images formed by the photoconductor drums 31 of the photoconductor units 13; first transfer rollers 52 that sequentially transfer the color toner images formed by the photoconductor units 13 to the intermediate transfer belt 51 (first transfer); and a second transfer roller 53 that carries out batch transfer of the color toner images superposed and transferred on the intermediate transfer belt 51 to the recording medium (second transfer).

The toner images formed on the photoconductor drums 31 of the photoconductor units 13 are electrostatically transferred (first transfer) in a sequential manner onto the intermediate transfer belt 51 by the first transfer rollers 52 to which a predetermined transfer voltage is applied from a power source device or the like (not depicted) controlled by the system control device, and superposed toner images in which the toner images are superposed are formed.

The superposed toner images on the intermediate transfer belt 51 are conveyed to a second transfer unit TR due to the movement of the intermediate transfer belt 51. The second transfer unit TR includes the second transfer roller 53 which is arranged pressed against a backup roller 65 with the intermediate transfer belt 51 interposed.

Paper is supplied to the second transfer unit TR from the paper feeding device 20 in accordance with the timing at which the superposed toner images are conveyed to the second transfer unit TR. A predetermined second transfer voltage is then applied from a power source device controlled by the system control device to the backup roller 65 that opposes the second transfer roller 53 with the intermediate transfer belt 51 interposed, and the superposed toner images on the intermediate transfer belt 51 are batch-transferred onto the paper.

Residual toner on the intermediate transfer belt 51 after transfer of the superposed toner images is removed by a cleaning device 70 and is recovered into a waste toner recovery device 100.

Residual toner on the surfaces of the photoconductor drums 31 is removed by the cleaning devices 33 and is recovered into the waste toner recovery device 100. The surfaces of the photoconductor drums 31 are recharged by the chargers 32.

The fixing device 17 has an endless fixing belt 17*a* that rotates in one direction and a pressure roller 17*b* that comes into contact with the peripheral surface of the fixing belt 17*a* and rotates in one direction, and a fixing region is formed by pressure contact between the fixing belt 17*a* and the pressure roller 17*b*.

The recording medium on which the toner images have been transferred in the transfer device 15 is conveyed to the fixing region of the fixing device 17 via the paper conveying device 16*a* with the toner images in a non-fixed state. The toner images are fixed to the recording medium conveyed to the fixing device 17, by the pair of the fixing belt 17*a* and the pressure roller 17*b* due to a heating and pressure-attaching action.

The recording medium for which fixing has been completed is fed to the paper output unit 30 via the paper conveying device 16*b*.

It should be noted that in a case where images are to be output to both sides of the recording medium, the front and rear of the recording medium are reversed by the paper conveying device 16*c*, and the recording medium is once again fed to the second transfer unit TR in the image forming unit 10. Then, after toner images are transferred and the transferred images are fixed, the recording medium is fed to the paper output unit 30. The recording medium that is fed to the paper output unit 30 is subjected to post-processing such as cutting and stapling (needle binding) as necessary, and is then output to the output paper housing unit.

(2) Waste Toner Recovery Path

Figure 2:
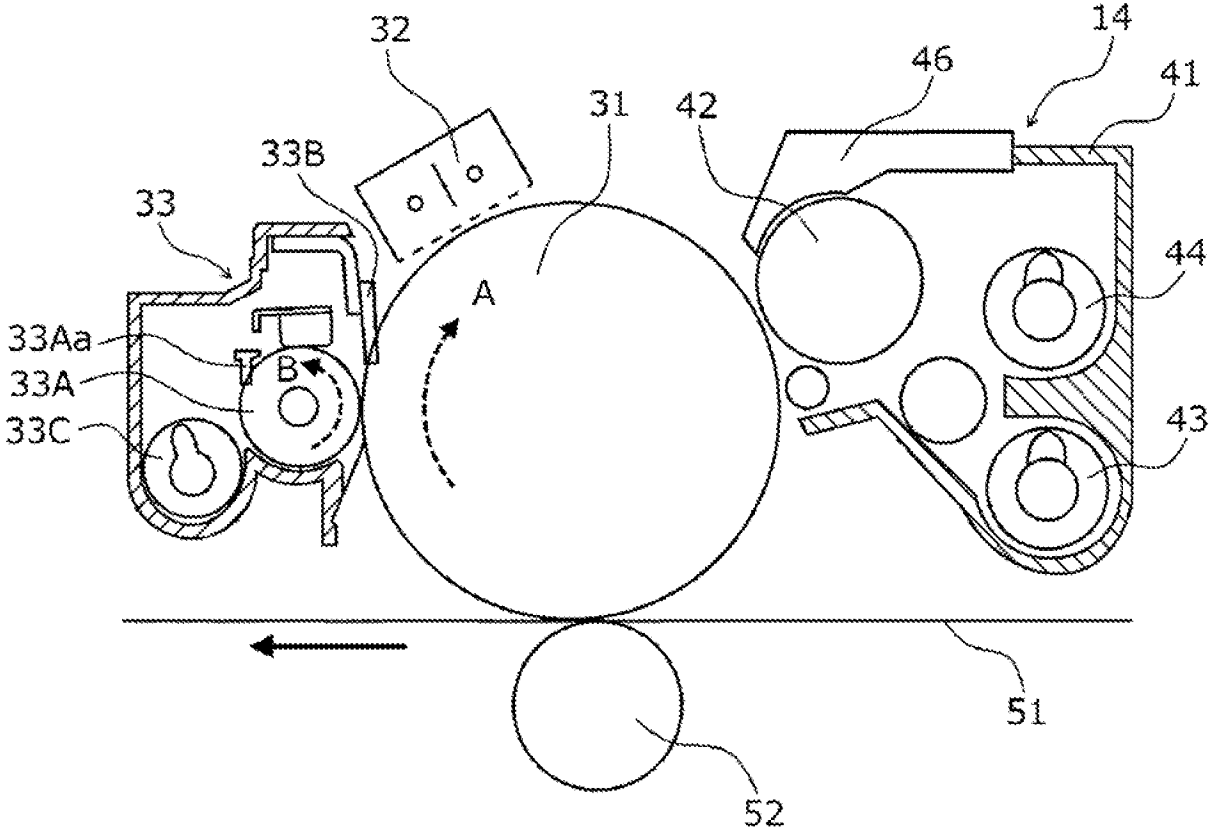
FIG. 2 is a drawing illustrating the configuration of a photoconductor unit and a developing device.
Figure 3:
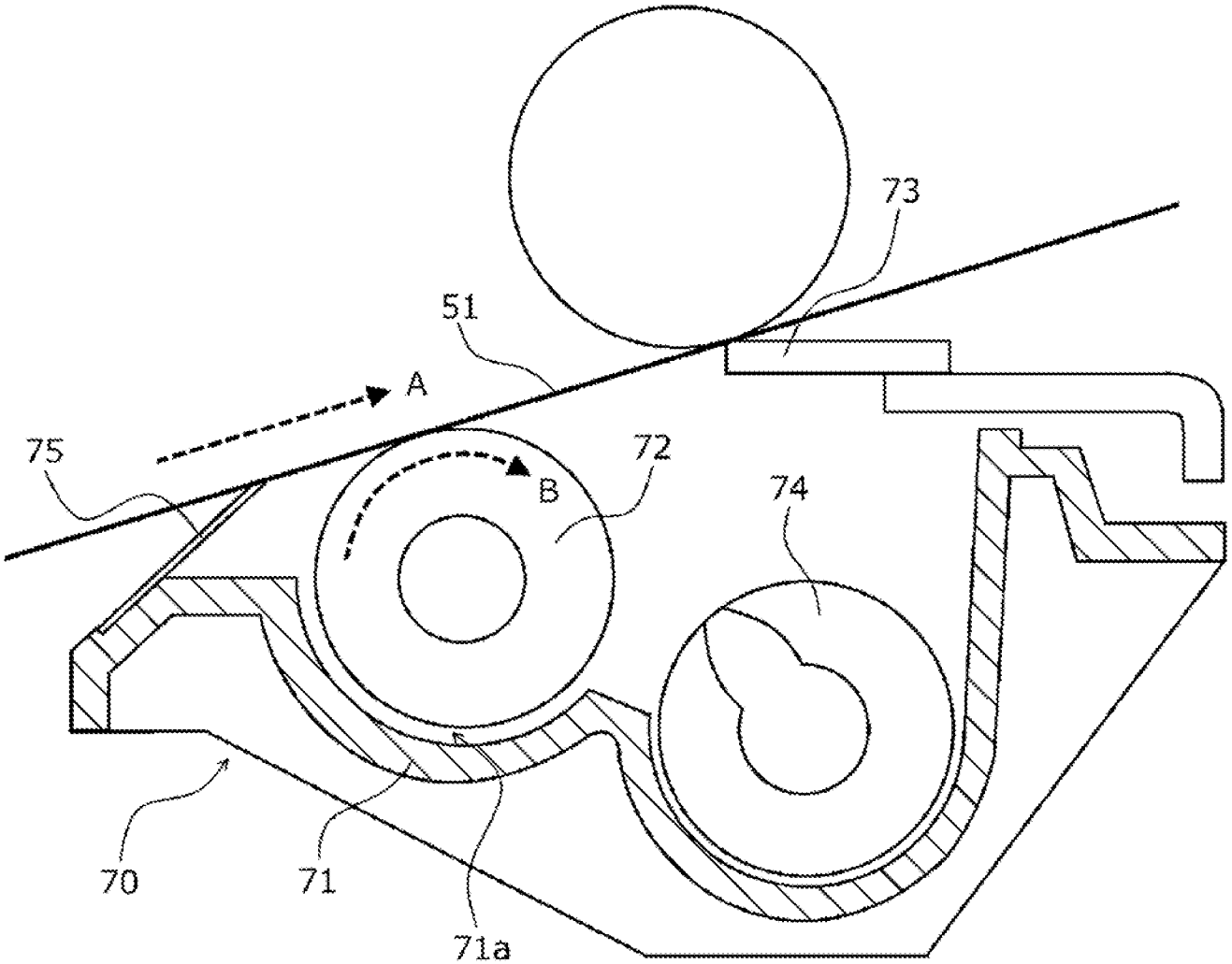
FIG. 3 is a cross-sectional schematic view depicting the configuration of a cleaning device.
Figure 4:
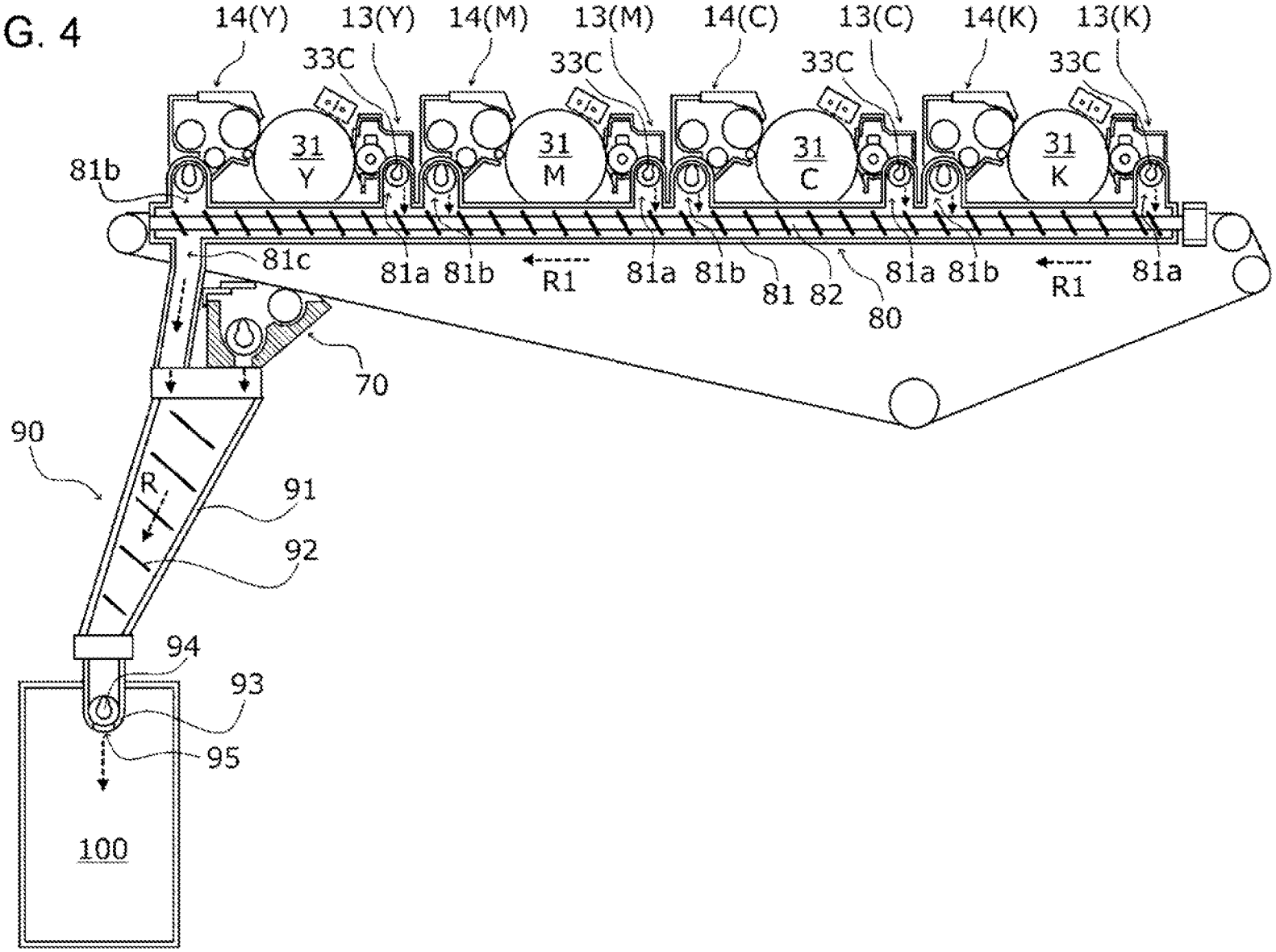
FIG. 4 is a side view depicting the overall configuration of a waste toner recovery device.
Figure 5:
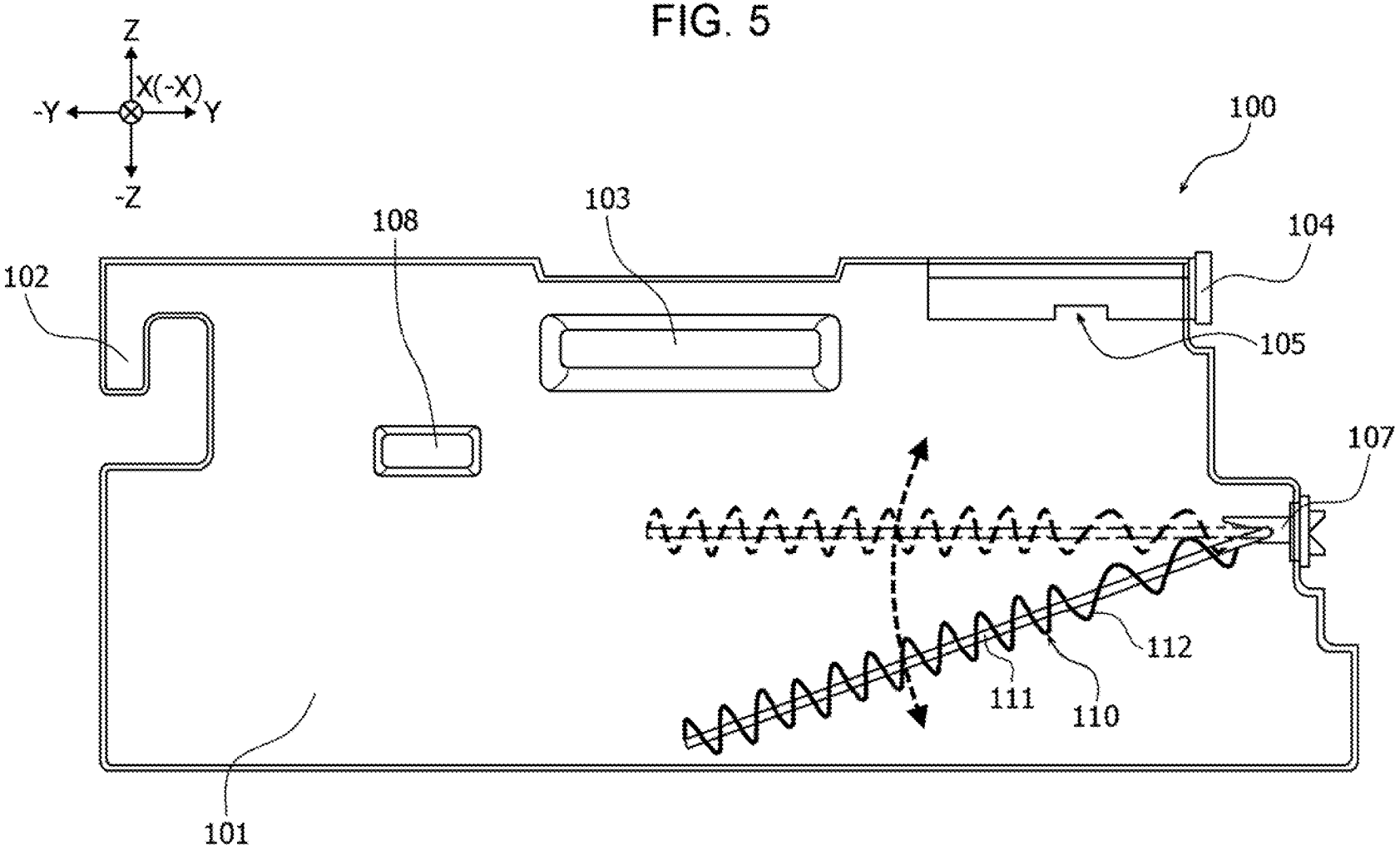
FIG. 5 is a drawing depicting a waste toner recovery path at the rear side of the image forming device.
Figure 6:
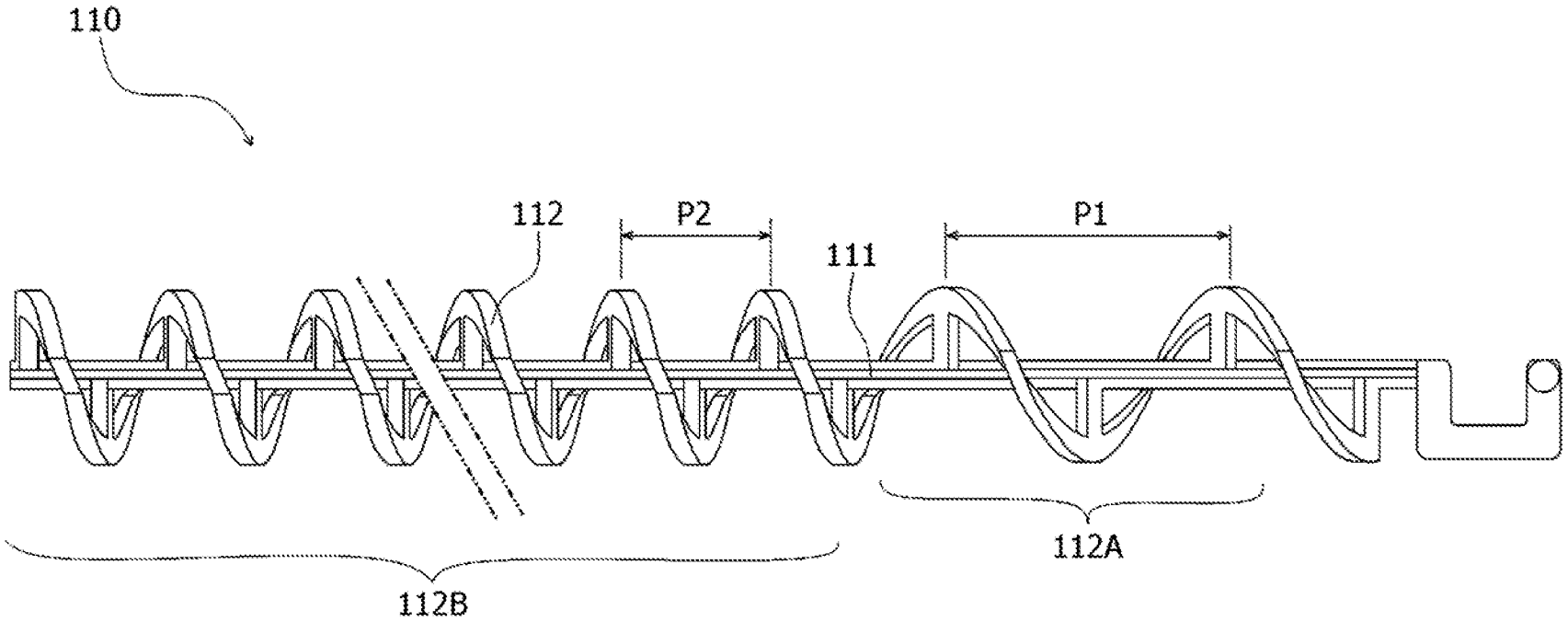
FIG. 6 is a drawing depicting a conveying auger of the waste toner recovery device.

FIG. 2 is a drawing illustrating the configuration of a photoconductor unit 13 and a developing device 14, FIG. 3 is a cross-sectional schematic view depicting the configuration of a cleaning device, FIG. 4 is a side view depicting the overall configuration of the waste toner recovery device 100, FIG. 5 is a drawing depicting a waste toner recovery path at the rear side of the image forming device 1, and FIG. 6 is a drawing depicting a conveying auger 110 of the waste toner recovery device 100.

Hereinafter, the configuration of the waste toner recovery path and the waste toner recovery device in the image forming device 1 will be described with reference to the drawings.

(2.1) Discharge of Waste Toner and Waste Developer

The cleaning device 33 of the photoconductor unit 13 depicted in FIG. 2 cleans recovered matter serving as waste powder that is on the photoconductor drum 31 after toner images have been first-transferred to the intermediate transfer belt 51. The recovered matter includes foreign matter or the like such as residual developer (toner and external additive) and paper powder that has adhered to the photoconductor drum 31 from the recording medium.

A cleaning brush 33A, while in contact with the surface of the photoconductor drum 31, rotates counterclockwise as indicated by arrow B in FIG. 2 (the photoconductor drum 31 rotates clockwise as indicated by arrow A in FIG. 2) and lifts up the recovered matter on the photoconductor drum 31 so as to facilitate the removal thereof.

A cleaning blade 33B scrapes off and thereby removes the recovered matter on the photoconductor drum 31 that has been lifted up by the cleaning brush 33A.

Also, a toner recovery auger 33C is provided in a lower section of the cleaning device 33 and, by rotating, conveys toner removed by the cleaning blade 33B and toner removed from the cleaning brush 33A by a flicker bar 33Aa and housed within the cleaning device 33, along a rotary shaft and outside (waste toner conveying unit 80; see FIG. 4) the cleaning device 33.

In the developing device 14, developer (toner including carrier) supplied into the developing housing 41 is stirred within the developing housing 41 by a stirring auger 43 and is conveyed to the developing roller 42 by a supply auger 44. A portion of the developer is then ultimately discharged outside (waste toner conveying unit 80; see FIG. 3) the developing device 14 as waste powder (hereinafter, referred to simply as developer).

In this way, new developer is supplied into the developing housing 41 and surplus developer is discharged, and, as a result, development is carried out using newly supplied developer without continuously using developer that includes deteriorated carrier.

(2.2) Recovery of Waste Toner from Transfer Device 15

On the intermediate transfer belt 51 of the transfer device 15, the cleaning device 70 is provided downstream from the second transfer unit TR in the movement direction of the intermediate transfer belt 51.

As depicted in FIG. 3, the cleaning device 70 is configured of a housing 71, a cleaning brush 72, a cleaning blade 73, a waste toner conveying auger 74, and a film 75, and recovers, from the intermediate transfer belt 51, transferred toner remaining on the intermediate transfer belt 51 after the second transfer.

The cleaning brush 72, while in contact with the surface of the intermediate transfer belt 51, rotates clockwise as indicated by arrow B in FIG. 3 (the intermediate transfer belt 51 moves as indicated by arrow A in FIG. 3), and lifts up the recovered matter (residual toner, paper powder, and the like) on the intermediate transfer belt 51 so as to facilitate the removal thereof.

The cleaning blade 73 scrapes off and thereby removes the recovered matter on the intermediate transfer belt 51 that has been lifted up by the cleaning brush 72.

A transport path 71*a* is formed in the housing 71. The transport path 71*a* is formed so as to extend from the front side toward the rear side of the device main body (Y direction) intersecting the movement direction of the intermediate transfer belt 51, and the waste toner conveying auger 74 is arranged therein.

The waste toner conveying auger 74 conveys recovered matter removed from the intermediate transfer belt 51 by the cleaning brush 72 and the cleaning blade 73, toward a waste toner dropping path 220 that is described later.

(2.3) Waste Toner Conveying Unit

The waste toner conveying unit 80 is provided at the rear side of the image forming device 1, and conveys waste toner and waste developer (hereinafter, referred to as waste powder) which are recovered matter recovered from the photoconductor unit 13 and the developing device 14.

The waste toner conveying unit 80 is arranged so as to extend horizontally (X direction) along the photoconductor units 13 (Y, M, C, K) and the developing devices 14 (Y, M, C, K) arranged along the intermediate transfer belt 51.

The waste toner conveying unit 80 is configured of a conveying tube 81 that is entirely hollow and houses waste powder therein, and a waste toner conveying auger 82 that conveys the waste powder.

Formed in the conveying tube 81 are receiving openings 81*a* that receive waste toner discharged from the toner recovery augers 33C (Y, M, C, K) of the photoconductor units 13 (Y, M, C, K), and receiving openings 81*b* that receive developer from the developing devices 14 (Y, M, C, K).

The waste toner conveying auger 82 has a spiral blade formed around a rotary shaft, receives a rotational force from a drive source (not depicted) and rotates along the inner wall within the conveying tube 81, thereby conveying, within the conveying tube 81, the waste powder received from the receiving openings 81*a* and 81*b* (X direction in FIG. 4; see arrow R1).

The waste powder conveyed by the waste toner conveying auger 82 within the conveying tube 81 arrives at a discharge opening 81*c* and thereupon drops along a waste toner dropping path 90.

(2.4) Waste Toner Dropping Path

The waste toner dropping path 90 is provided at the rear side of the image forming device 1, and receives and causes waste powder discharged from the waste toner conveying unit 80 and the cleaning device 70 to drop toward the waste toner recovery device 100 (−Z direction) while being stirred.

The waste toner dropping path 90 is configured of: a tubular member 91; an agitator 92 that advances and retreats so as to vibrate in the up-down direction in the internal space in the tubular member 91 and breaks down waste powder that has adhered to the inner wall; and a drive source (not depicted) that transmits a driving force for causing the agitator 92 to advance and retreat. The waste toner dropping path 90 is arranged in a substantially perpendicular direction with respect to the discharge port 81*c* of the waste toner conveying unit 80 and a discharge port 71B of the cleaning device 70.

The waste toner dropping path 90 causes waste powder received from the waste toner conveying unit 80 and the cleaning device 70 to drop toward the waste toner recovery device 100 while being stirred by the agitator 92 (see arrow R in FIG. 4).

(2.5) Waste Toner Recovery Device

The waste toner recovery device 100 has a recovery container 101 having provided therein a space for housing waste powder such as waste developer and waste toner. A grip 102 that is used when the waste toner recovery device 100 is attached or detached with respect to the device main body (see FIG. 1) is formed so as to protrude at the front side (−Y direction) of the recovery container 101. Furthermore, a handle (recess) 103 provided to facilitate carrying of the waste toner recovery device 100 is formed in the center of the upper side of the recovery container 101.

An insertion opening 104 into which a conveying pipe 93 (see FIG. 4) provided in the device main body can be inserted is provided in the upper-side surface at the rear side (Y direction) of the recovery container 101. A rotatable conveying auger 94 is provided within the conveying pipe 93 of the waste toner dropping path 90. The conveying pipe 93 and the conveying auger 94 then convey waste powder that drops from the waste toner dropping path 90, and a discharge opening 95 for discharging the conveyed waste powder is provided in the lower section at the end-section side of the conveying pipe 93.

An inlet 105 that opens upward and receives waste powder discharged from the discharge opening 95 in the conveying pipe 93 is provided in an inner lower section of the insertion opening 104 in the recovery container 101. In addition, a shutter 106 (not depicted) that opens the inlet 105 when the conveying pipe 93 is inserted into the insertion opening 104 and closes the inlet 105 when the conveying pipe 93 is extracted from the insertion opening 104 (when the waste toner recovery device 100 is detached from the device main body) is provided inside the insertion opening 104. The shutter 106 is biased toward the rear side (Y direction) by a coil spring (not depicted), and opens the inlet 105 by being pushed in by the conveying pipe 93.

A coupling member 107 that is rotatably provided is mounted in substantially the center of the side surface at the rear side (Y direction) of the recovery container 101, and the conveying auger 110 which serves as a conveying component extending within the recovery container 101 is attached to the coupling member 107.

The conveying auger 110 is made of a synthetic resin such as POM, has a spiral blade 112 that is formed integrally with a shaft body 111 with a gap being maintained therebetween, and has a reduced weight compared to being made of metal. The conveying auger 110 formed in this manner rotates together with the rotation of the coupling member 107, which is rotationally driven by a drive system (not depicted) of the device main body.

Furthermore, in the present exemplary embodiment, the conveying auger 110 extends up to substantially the central section within the recovery container 101, and one end section that is not attached to the coupling member 107 is a free end. In other words, the conveying auger 110 is cantilever-supported in such a way as to swing freely, as indicated by the arrow in FIG. 5.

Furthermore, in the conveying auger 110, the spiral blade 112 has a first conveying section 112A that conveys with a first conveying force and a second conveying section 112B that conveys with a second conveying force that is larger than the first conveying force. Specifically, the pitch (see P1 and P2 in FIG. 6) of the spiral blade 112 is wider in the first conveying section 112A than in the second conveying section 112B, as depicted in FIG. 6. More specifically, the pitch of the spiral blade 112 is formed such that the pitch P1 in the first conveying section 112A is two or more times wider than the pitch P2 in the second conveying section 112B. The actions of the first conveying section 112A and the second conveying section 112B will be described later.

A full-state detection sensor SNR (not depicted) serving as a detection component that detects whether or not the waste powder housed within the recovery container 101 has reached a predetermined height is attached to the device main body corresponding to a side surface of the recovery container 101. In the present exemplary embodiment, the full-state detection sensor SNR is an optical sensor that is capable of directly detecting a deposition amount, and a detection window 108 through which the full-state detection sensor SNR detects the deposition amount is provided in the recovery container 101. It should be noted that the full-state detection sensor SNR is not restricted to being an optical sensor, and a magnetic permeability sensor that performs level detection using the magnetism of the carrier included in the waste developer may be used.

(3) Recovery Operation for Waste Powder

Figure 7A:
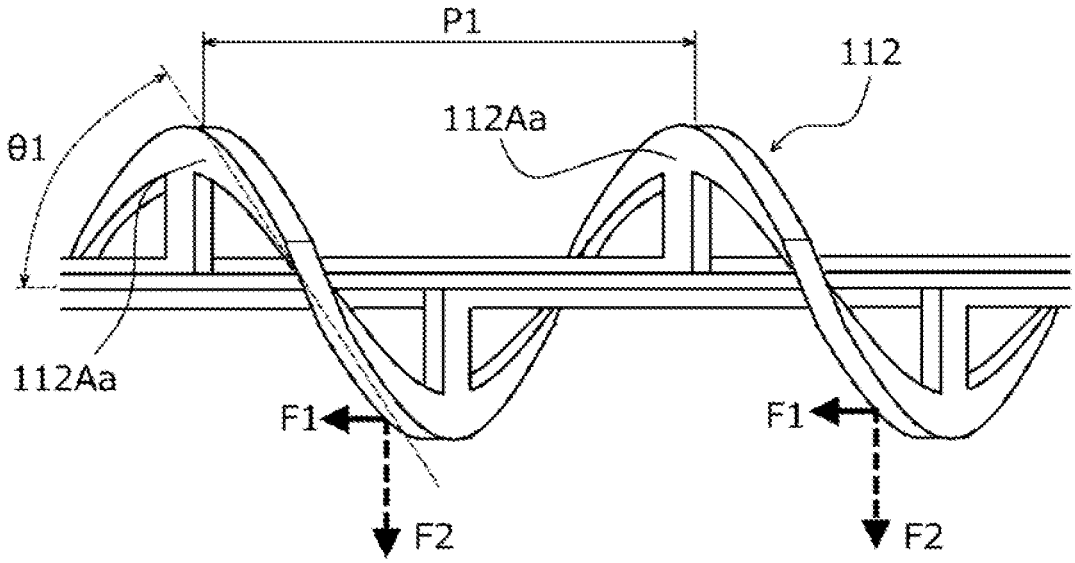
FIGS. 7A and 7B are drawings illustrating the waste toner conveying action of the conveying auger.
Figure 7B:
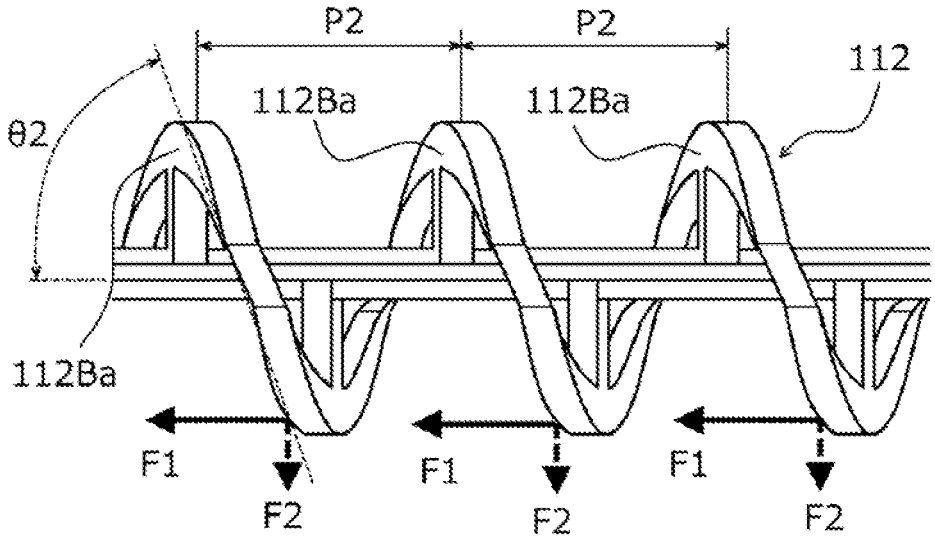
Figure 8:
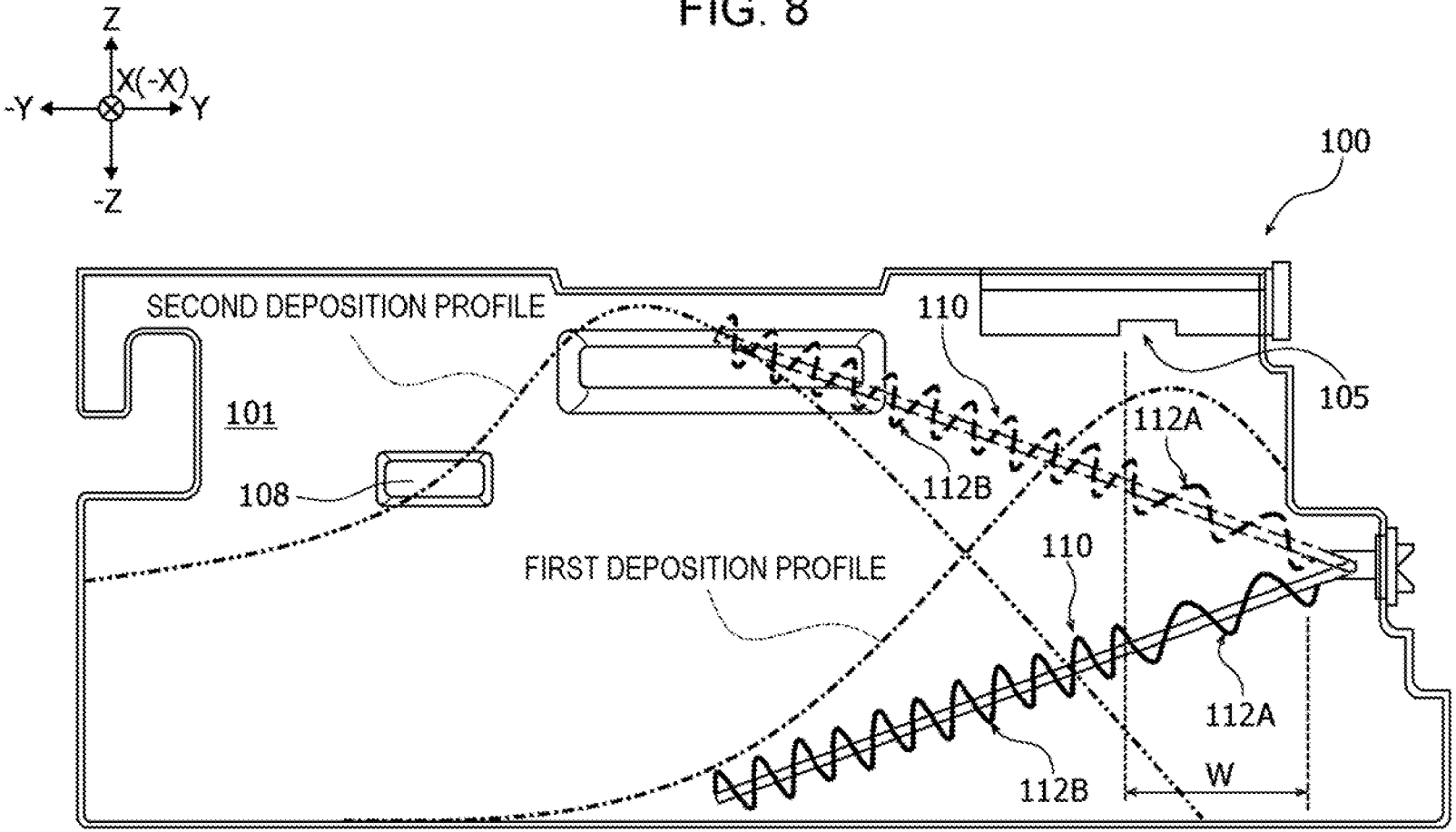
FIG. 8 is a drawing for describing the relationship between the conveying auger and deposition profiles for waste powder housed in a recovery container.
Figure 12:
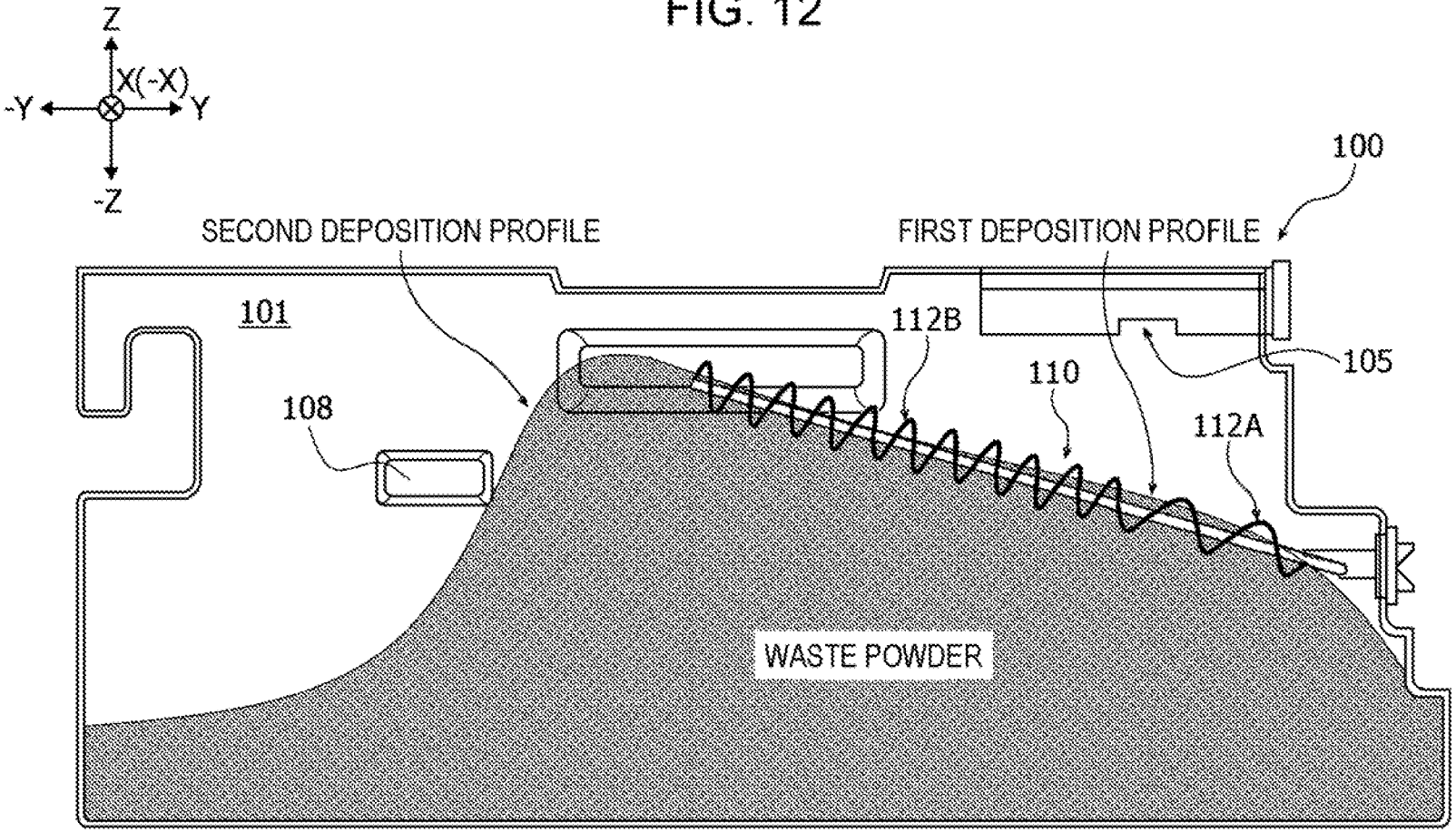
FIG. 12 is a drawing for describing the relationship between the amount of waste powder housed in the recovery container and the position of the conveying auger.
Figure 13:
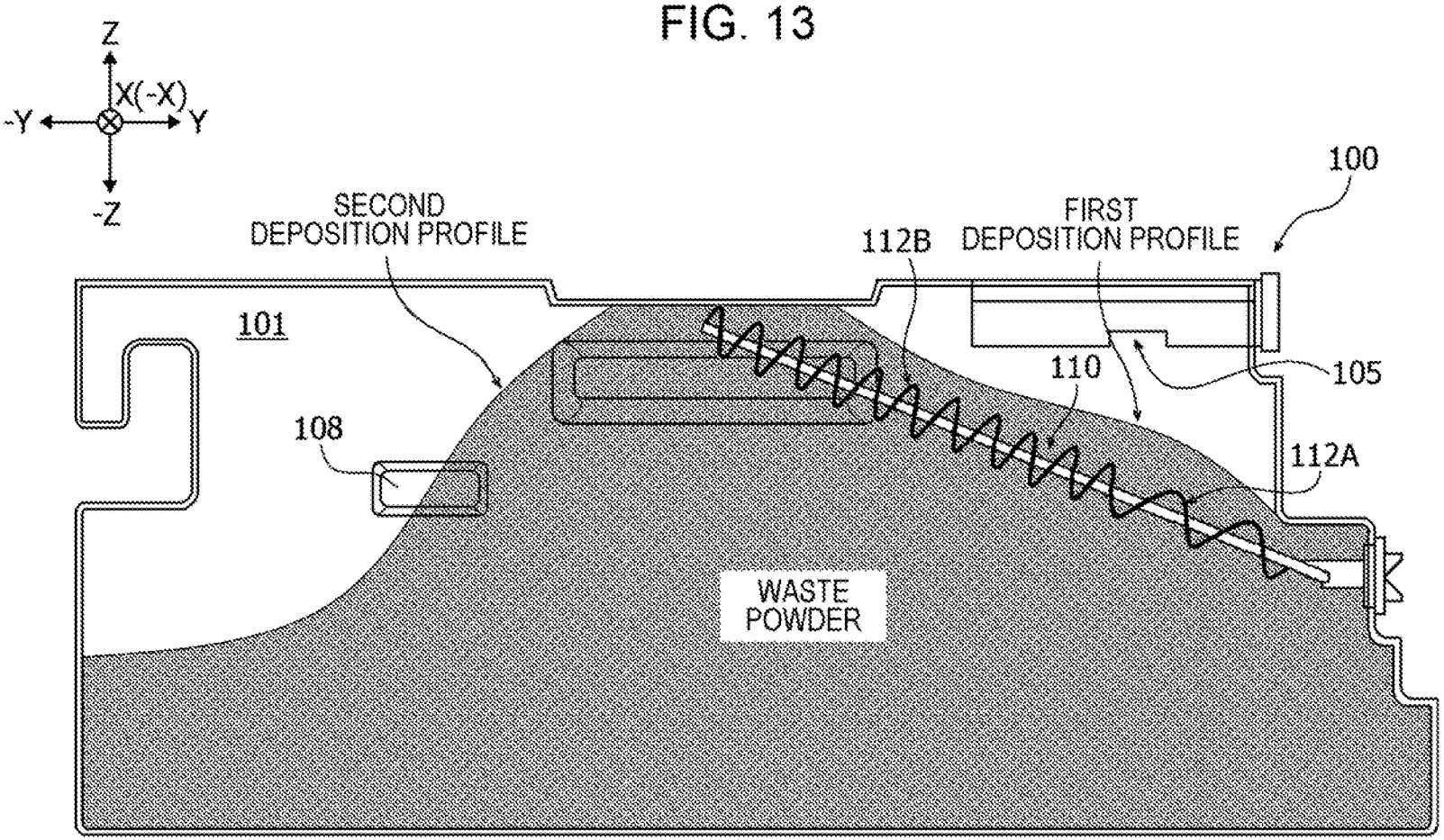
FIG. 13 is a drawing for describing the relationship between the amount of waste powder housed in the recovery container and the position of the conveying auger.
Figure 14:
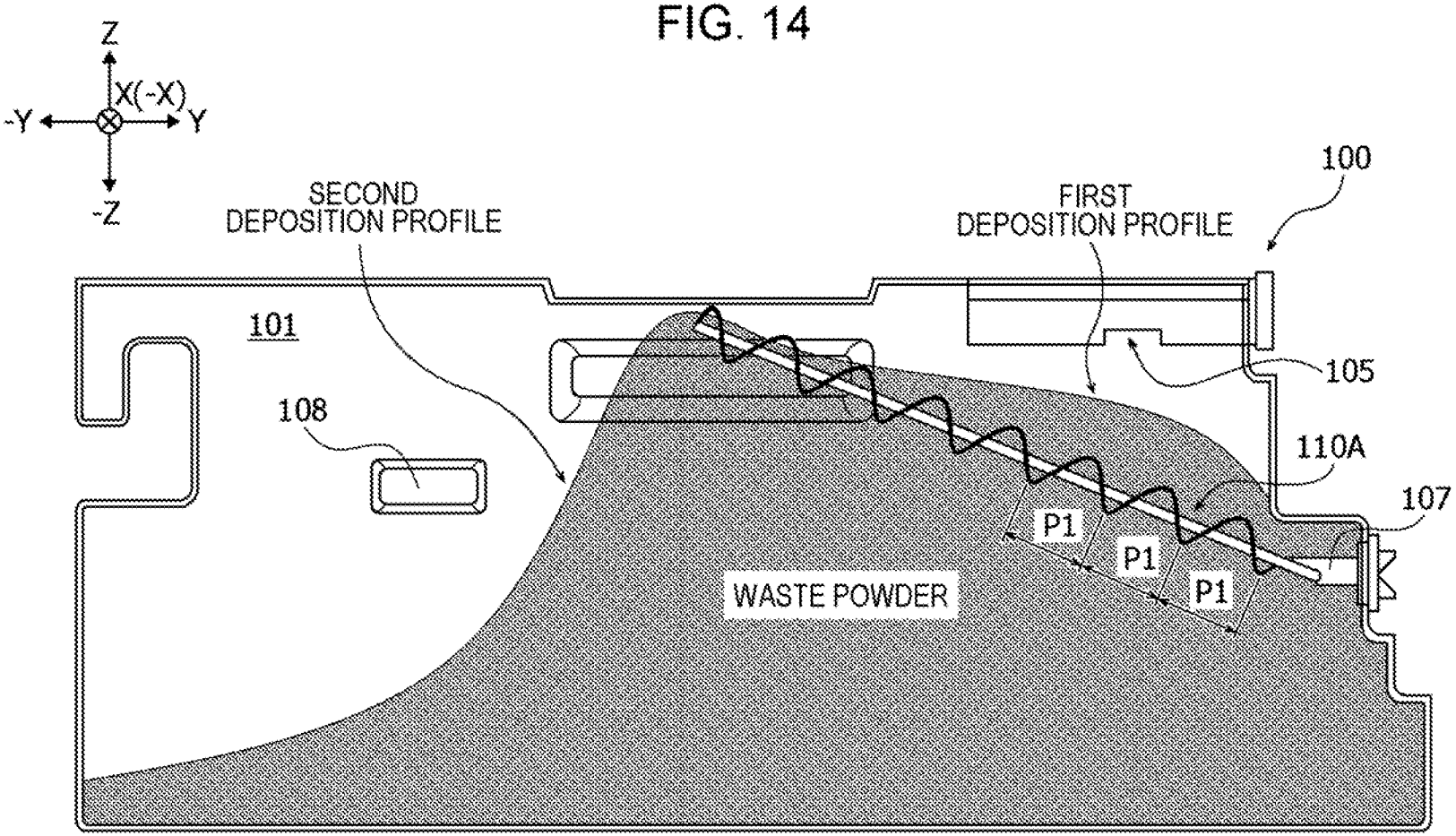
FIG. 14 is a drawing for describing the relationship between the amount of waste powder housed in a recovery container having a conveying auger and the position of the conveying auger according to comparative example 1.
Figure 15:
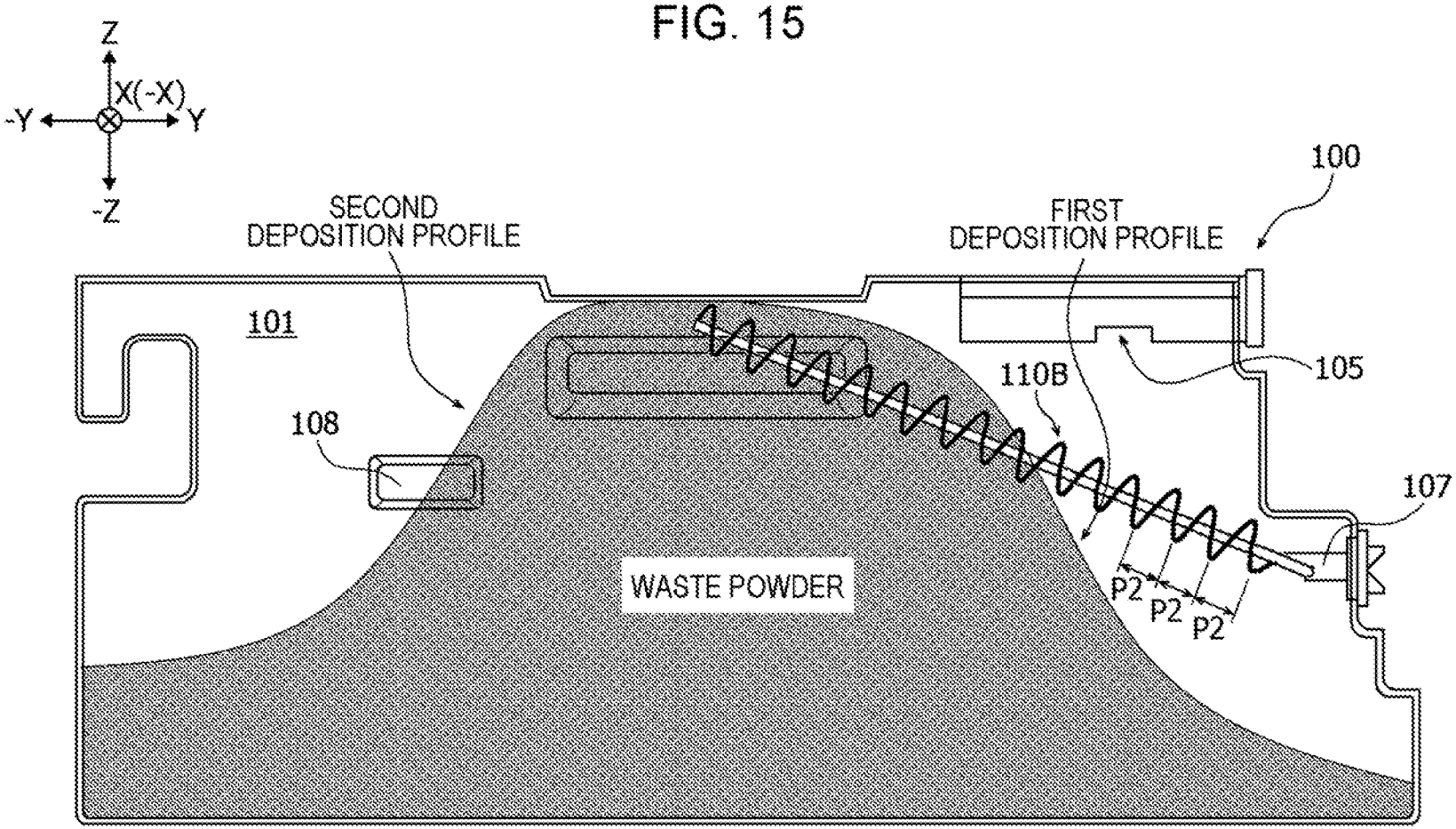
FIG. 15 is a drawing for describing the relationship between the amount of waste powder housed in a recovery container having a conveying auger and the position of the conveying auger according to comparative example 2.

FIGS. 7A and 7B are drawings illustrating a waste toner conveying action of the conveying auger 110, FIG. 8 is a drawing for describing the relationship between the conveying auger 110 and deposition profiles for waste powder housed in the recovery container 101, FIGS. 9 to 13 are drawings for describing the relationship between the amount of waste powder housed in the recovery container 101 and the position of the conveying auger 110, FIG. 14 is a drawing for describing the relationship between the amount of waste powder housed in the recovery container 101 having a conveying auger 110A and the position of the conveying auger 110A according to comparative example 1, and FIG. 15 is a drawing for describing the relationship between the amount of waste powder housed in the recovery container 101 having a conveying auger 110B and the position of the conveying auger 110B according to comparative example 2.

Hereinafter, the recovery of waste powder in the waste toner recovery device 100 will be described with reference to the drawings.

(3.1) Conveying Action of Conveying Auger

It is known that the magnitudes of a conveying force F1 in the axial direction and a discharging force F2 in the radial direction change according to the pitch P of the spiral blade 112 of the conveying auger 110, as depicted in FIGS. 7A and 7B. For example, as depicted in FIG. 7A, in a case where the pitch P1 of the spiral blade is wide, a surface 112Aa of the spiral blade faces the axial direction at an acute angle (θ1 in FIG. 7B), and therefore the conveying force F1 decreases and the discharging force F2 in a direction intersecting the relative movement direction of the spiral blade increases. On the other hand, as depicted in FIG. 7B, in a case where the pitch P2 of the spiral blade is narrow, a surface 112Ba of the spiral blade faces the axial direction at an obtuse angle (θ2 in FIG. 7B), and therefore the conveying force F1 increases and the discharging force F2 in a direction intersecting the relative movement direction of the spiral blade decreases.

Then, as depicted in FIG. 8, in the conveying auger 110, the first conveying section 112A having a wide pitch P1 for the spiral blade is provided in a range (represented by W in FIG. 8) including a position below the inlet 105, and the second conveying section 112B having a narrow pitch P2 for the spiral blade is provided to the tip-end side of the conveying auger 110 in continuation from the first conveying section 112A.

As a result, the first conveying section 112A having a wide pitch P1 for the spiral blade has a greater action of discharging waste powder in a direction intersecting the axial direction and causes waste powder to be deposited at the rear side (Y direction) of the recovery container 101, and the second conveying section 112B having a narrow pitch P2 for the spiral blade has a greater action of conveying waste powder in the axial direction and causes waste powder to be conveyed and deposited toward the front side (−Y direction) of the recovery container 101.

Thereby, as schematically depicted in FIG. 8, the first conveying section 112A of the conveying auger 110 causes waste powder that drops from the inlet 105 to pile up according to a first deposition profile (the one-dot chain line in FIG. 8) at the rear side (Y direction) of the recovery container 101. Furthermore, the second conveying section 112B causes waste powder that drops from the inlet 105 to be conveyed toward the front side (−Y direction) of the recovery container 101 and pile up according to a second deposition profile (the two-dot chain line in FIG. 8).

In this way, the conveying auger 110 has the first conveying section 112A with which waste powder received from the inlet 105 piles up according to the first deposition profile and the second conveying section 112B with which waste powder piles up according to the second deposition profile, and, by altering the respective pitches P1 and P2 in the first conveying section 112A and the second conveying section 112B as appropriate, it is possible to maximize the capacity of the recovery container 101 due to the combination of the first deposition profile and the second deposition profile.

(3.2) Recovery Operation for Waste Powder

Next, the recovery operation for waste powder in the waste toner recovery device 100 will be described with reference to the FIGS. 9 to 15.

FIG. 14 depicts a state where waste powder is housed in the recovery container 101 having a conveying auger 110A according to comparative example 1. The conveying auger 110A is formed with the spiral blade 112 having the same pitch from the base-end section to the free-end section, and, specifically, has a spiral blade having a wide pitch P1 similar to the first conveying section 112A of the conveying auger 110 according to the present exemplary embodiment from the base-end section to the tip-end section.

In a case where waste powder is brought in from the inlet 105 into the recovery container 101 provided with this kind of conveying auger 110A, the waste powder, first, deposits on the bottom section (bottom section at the rear side) of the recovery container 101 directly below the inlet 105. Then, when a certain degree of waste powder deposits within the recovery container 101, the waste powder at the upper-section side thereof is conveyed toward the front side (−Y direction) of the recovery container 101 by the conveying auger 110A which rotates, and is also deposited at the front side (−Y direction) within the recovery container 101.

Also, the conveying auger 110A, due to receiving pressure from the waste powder that deposits within the recovery container 101, is raised about the position of attachment to the coupling member 107 and moves upward to the position depicted in FIG. 14, and the waste powder piles up within the recovery container 101 while being conveyed toward the front side (−Y direction) of the recovery container 101.

Here, in the conveying auger 110A, the spiral blade 112 is formed in a uniform manner having the wide pitch P1 from the base-end section to the free-end section, and therefore the conveying force F1 in the axial direction is relatively small compared to the discharging force F2 in a direction intersecting the axial direction. Then, at the rear side (Y direction) of the recovery container 101, the waste powder piles up to the upper surface of the recovery container 101 according to the first deposition profile; however, at the front side (−Y direction) of the recovery container 101, the waste powder does not pile up sufficiently according to the second deposition profile, and the amount of waste powder housed in the recovery container 101 is not maximized.

FIG. 15 depicts a state where waste powder is housed in the recovery container 101 having a conveying auger 110B according to comparative example 2. The conveying auger 110B is formed with the spiral blade 112 having the same pitch from the base-end section to the free-end section, and, specifically, has a spiral blade having the narrow pitch P2 similar to the second conveying section 112B of the conveying auger 110 according to the present exemplary embodiment from the base-end section to the tip-end section.

In a case where waste powder is brought in from the inlet 105 into the recovery container 101 provided with this kind of conveying auger 110B, the waste powder, first, deposits on the bottom section (bottom section at the rear side) of the recovery container 101 directly below the inlet 105. Then, when a certain degree of waste powder deposits within the recovery container 101, the waste powder at the upper-section side thereof is conveyed toward the front side (−Y direction) of the recovery container 101 by the conveying auger 110B which rotates, and is also deposited at the front side (−Y direction) within the recovery container 101.

In the conveying auger 110B, the spiral blade 112 is formed in a uniform manner having the narrow pitch P2 from the base-end section to the free-end section, and therefore the conveying force F1 in the axial direction is greater than the discharging force F2 in a direction intersecting the axial direction. Thus, at the front side (−Y direction) of the recovery container 101, the waste powder piles up sufficiently according to the second deposition profile; however, at the rear side (Y direction) of the recovery container 101, the waste powder does not sufficiently pile up to the upper surface of the recovery container 101 according to the first deposition profile, and the amount of waste powder housed is not maximized.

Figure 9:
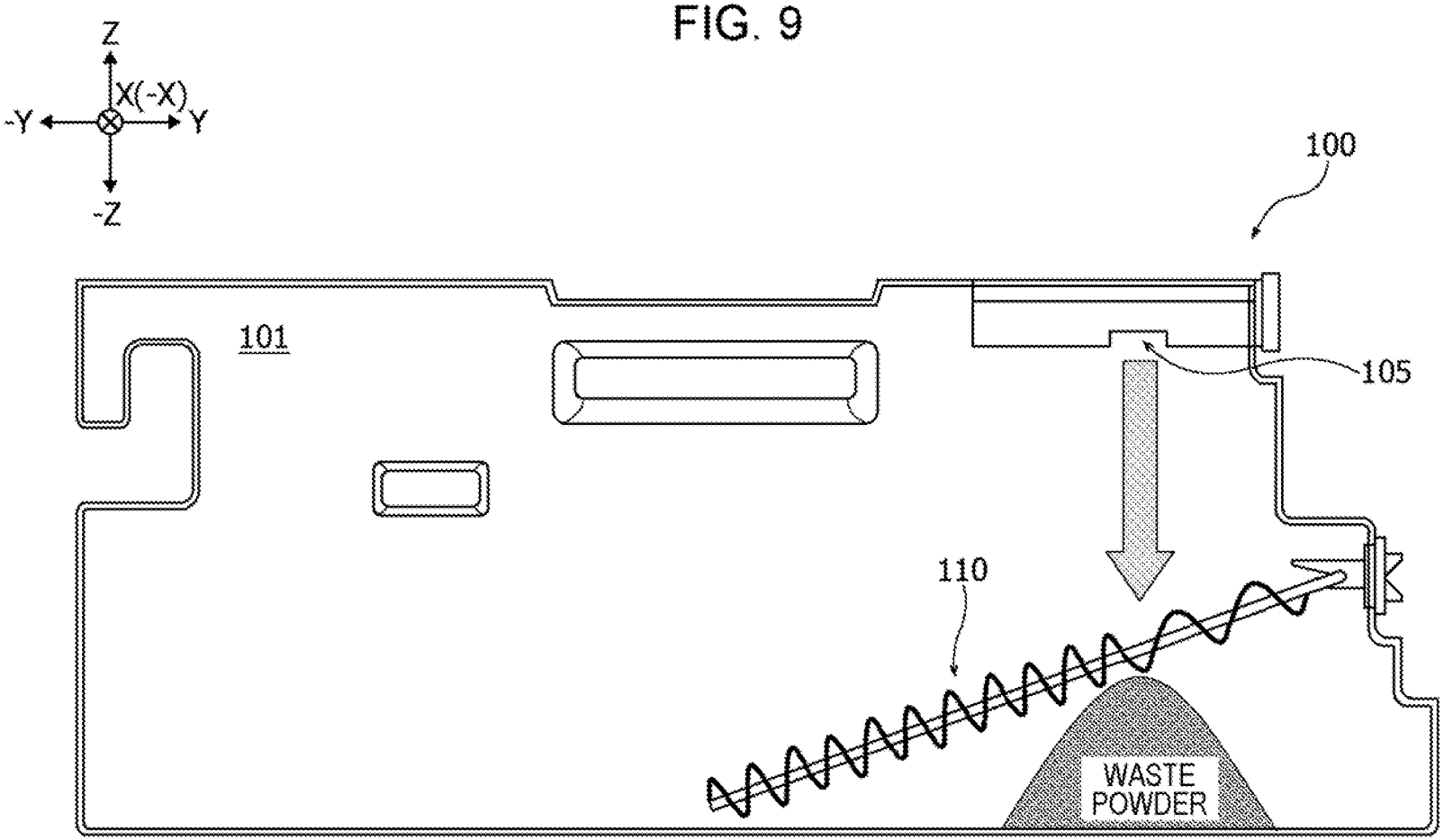
FIG. 9 is a drawing for describing the relationship between the amount of waste powder housed in the recovery container and the position of the conveying auger.

FIG. 9 depicts an initial stage, in other words, a state where waste powder has started to be recovered within the recovery container 101. At such time, the tip-end section (free-end section) of the conveying auger 110 hangs down toward the lower section due to its own weight and is at the bottom of the recovery container 101. Waste powder that is brought into the recovery container 101 from the inlet 105, first, deposits on the bottom section (bottom section at the rear side) of the recovery container 101 directly below the inlet 105.

Figure 10:
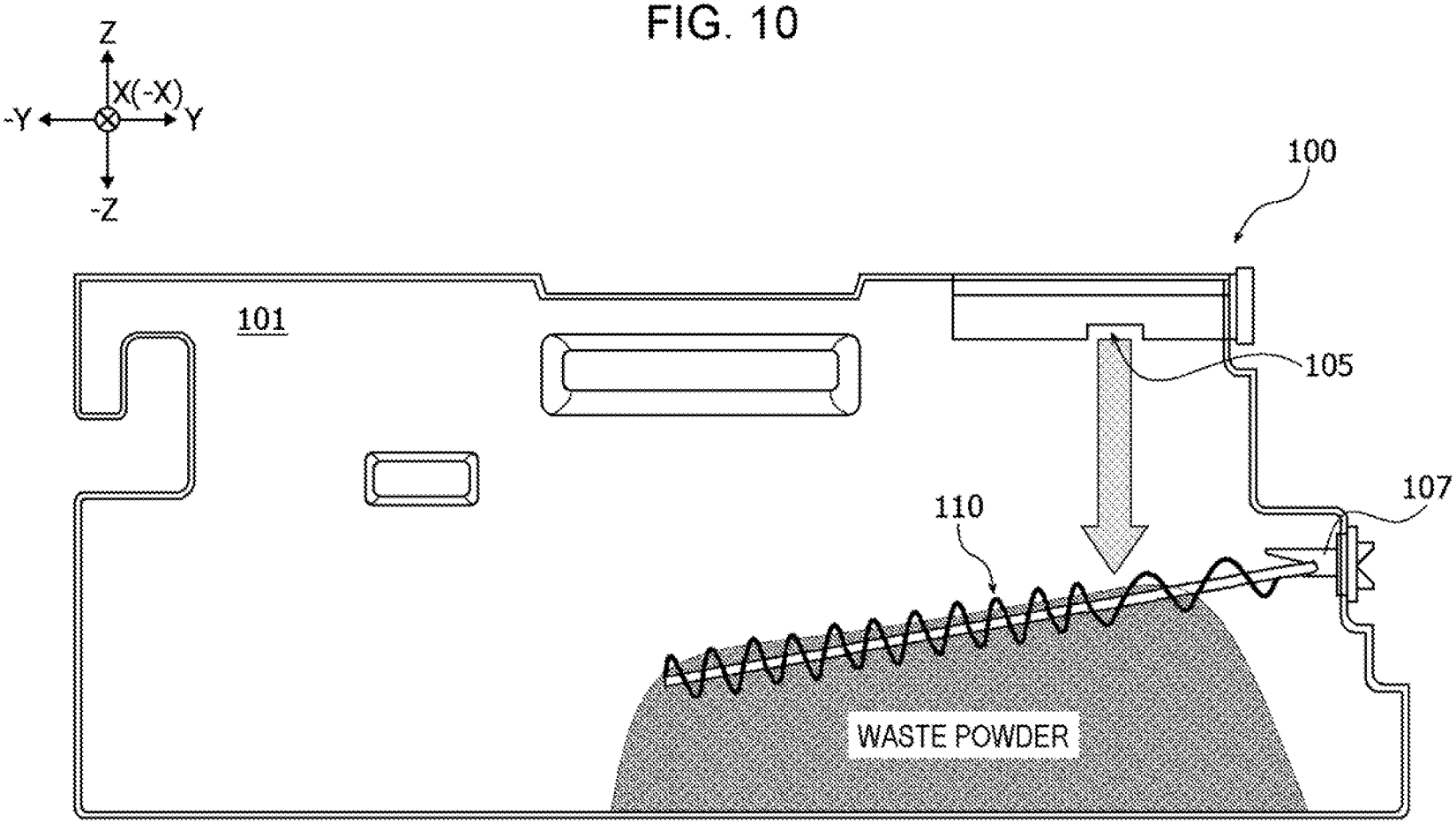
FIG. 10 is a drawing for describing the relationship between the amount of waste powder housed in the recovery container and the position of the conveying auger.

Then, when a certain degree of waste powder deposits within the recovery container 101, the waste powder at the upper-section side thereof is conveyed toward the front side (−Y direction) of the recovery container 101 by the conveying auger 110 which rotates. FIG. 10 depicts the state at such time. From FIG. 10, as a result of the waste powder being conveyed by the conveying auger 110, the height of the waste powder is made uniform within the recovery container 101. Furthermore, as a result of the waste powder being conveyed within the recovery container 101, it is also possible for the bulk density of the waste powder to be increased.

Also, the conveying auger 110, due to receiving pressure from the waste powder that deposits within the recovery container 101, is raised about the position of attachment to the coupling member 107 and moves upward to the position depicted in FIG. 10. Specifically, due to the conveying auger 110 swinging, the conveying auger 110 adopts a position where the conveying auger 110 has an angle that is substantially the same as that of the upper surface of the waste powder that deposits within the recovery container 101.

Figure 11:
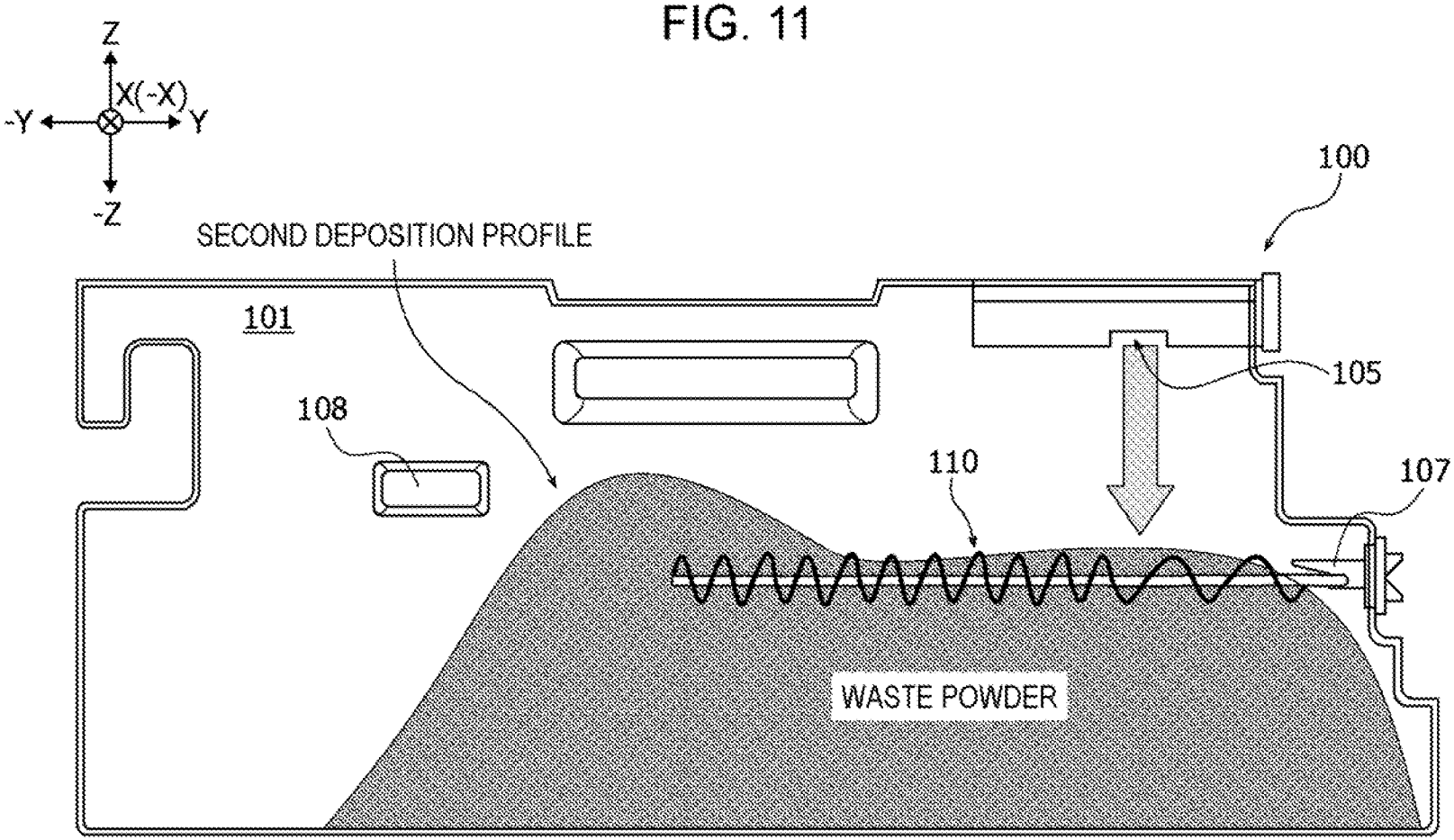
FIG. 11 is a drawing for describing the relationship between the amount of waste powder housed in the recovery container and the position of the conveying auger.

FIG. 11 depicts a state where waste powder has been further brought into the recovery container 101. At such time, the conveying auger 110 moves to the upper surface level of the deposited waste powder, adopts a substantially horizontal state, and the waste powder starts to pile up according to the second deposition profile within the recovery container 101.

FIG. 12 depicts a state where waste powder has been further brought into the recovery container 101 and the recovery container 101 is substantially full. At such time, the conveying auger 110 moves to the upper surface level of the deposited waste powder, the free-end side becomes higher than the coupling member 107 side, and, within the recovery container 101, the waste powder piles up according to the first deposition profile at the rear side (Y direction) of the recovery container 101. The waste powder is then conveyed to the front side (−Y direction) of the recovery container 101 due to the second conveying section 112B of the conveying auger 110 and piles up according to the second deposition profile.

FIG. 13 depicts a state where waste powder has been further brought into the recovery container 101 and the free-end side of the conveying auger 110 has swung to a position touching the upper surface of the recovery container 101. When the free-end side of the conveying auger 110 touches the upper surface of the recovery container 101, a state is entered in which the conveying auger 110 is supported at both the free-end side and the base-end side attached to the coupling member 107, and the conveying force produced by the spiral blade in the second conveying section 112B increases. As a result, a state is entered where waste powder further piles up at the front side (−Y direction) of the recovery container 101 and fills the detection window 108. Thus, the waste powder is housed from the rear side (Y direction) to the front side (−Y direction) up to the upper surface of the recovery container 101 in a substantially uniform manner and a full state is detected.

In this way, in the present exemplary embodiment, the conveying auger 110 is swingably arranged with respect to the coupling member 107 which is rotatably attached to the recovery container 101. Thus, the conveying auger 110 is able to follow and move up to a height that is the same as or slightly higher than the deposition height of the waste powder in accordance with the deposition height of the waste powder within the recovery container 101.

Also, in the conveying auger 110, the spiral blade has the first conveying section 112A that conveys with a first conveying force and the second conveying section 112B that conveys with a second conveying force that is larger than the first conveying force. Therefore, the waste powder received from the inlet 105 is piled up according to the first deposition profile by the first conveying section 112A, the waste powder is piled up according to the second deposition profile while being conveyed to the front side (−Y direction) of the recovery container 101 by the second conveying section 112B, and it becomes possible to maximize the amount of waste powder housed in the recovery container 101.

In the present exemplary embodiment, the waste powder has been described as toner and developer, but the present disclosure may be applied to a manufacturing device or the like in which waste powder is produced. For example, in a manufacturing device that manufactures an electrode body of a secondary battery, the present disclosure may be applied as a device that recovers waste powder such as surplus carbon black that is produced during manufacturing.

Furthermore, the types of waste powder are not restricted to types such as carbon powder, magnetic powder, metal powder, powder for pharmaceutical products, and powder for food products. In addition, the form of device is not restricted as long as it is a device that recovers waste powder, such as a manufacturing device, a processing device, an inspection device, or the like.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A waste powder recovery device comprising:

a recovery container that houses waste powder and has an inlet through which the waste powder is received; and a conveying component that is cantilever-supported in such a way as to swing freely inside the recovery container, the conveying component having a first conveying section with which the waste powder brought in through the inlet is conveyed with a first conveying force within the recovery container, and a second conveying section with which the waste powder is conveyed with a second conveying force that is larger than the first conveying force.

2. The waste powder recovery device according to claim 1, wherein the conveying component has a spiral blade, is rotationally driven, and thereby conveys the waste powder.

3. The waste powder recovery device according to claim 2, wherein, in the first conveying section, a pitch of the spiral blade is wider than in the second conveying section.

4. The waste powder recovery device according to claim 3, wherein the first conveying section is formed in a range including a position below the inlet from a cantilever-supported base end of the conveying component.

5. The waste powder recovery device according to claim 2, wherein, in the first conveying section, a pitch of the spiral blade is two or more times wider than in the second conveying section.

6. The waste powder recovery device according to claim 2, wherein the first conveying section is formed in a range including a position below the inlet from a cantilever-supported base end of the conveying component.

7. The waste powder recovery device according to claim 1, wherein the first conveying section is formed in a range including a position below the inlet from a cantilever-supported base end of the conveying component.

8. The waste powder recovery device according to claim 1, wherein the conveying component has a shaft body, and the spiral blade is formed integrally with the shaft body with a gap being maintained therebetween.

9. The waste powder recovery device according to claim 1, wherein the conveying component is formed using a synthetic resin.

10. An image forming device comprising:

a first conveying component that conveys waste powder recovered from an image forming component that forms a toner image; and a second conveying component that causes the waste powder to drop toward the waste powder recovery device according to claim 1.

11. A waste powder recovery device comprising:

a recovery container that houses waste powder and has an inlet through which the waste powder is received; and a conveying component that is cantilever-supported in such a way as to swing freely inside the recovery container, the conveying component having a first conveying section with which the received waste powder is conveyed with a first conveying force and piled up according to a first deposition profile within the recovery container, and a second conveying section with which the waste powder is conveyed with a second conveying force that is larger than the first conveying force and piled up according to a second deposition profile that is higher than the first deposition profile.

12. The waste powder recovery device according to claim 11, wherein the conveying component has a spiral blade, is rotationally driven, and thereby conveys the waste powder.

13. The waste powder recovery device according to claim 12, wherein, in the first conveying section, a pitch of the spiral blade is wider than in the second conveying section.

14. The waste powder recovery device according to claim 13, wherein the first conveying section is formed in a range including a position below the inlet from a cantilever-supported base end of the conveying component.

15. The waste powder recovery device according to claim 12, wherein, in the first conveying section, a pitch of the spiral blade is two or more times wider than in the second conveying section.

16. The waste powder recovery device according to claim 12, wherein the first conveying section is formed in a range including a position below the inlet from a cantilever-supported base end of the conveying component.

17. The waste powder recovery device according to claim 11, wherein the first conveying section is formed in a range including a position below the inlet from a cantilever-supported base end of the conveying component.

18. The waste powder recovery device according to claim 11, wherein the conveying component has a shaft body, and the spiral blade is formed integrally with the shaft body with a gap being maintained therebetween.

19. The waste powder recovery device according to claim 11, further comprising a detection component that detects whether or not the waste powder that has piled up according to the second deposition profile within the recovery container has reached a predetermined height.

20. The waste powder recovery device according to claim 15, wherein the detection component is arranged at a height that is reached by the waste powder when the waste powder substantially fills the recovery container, and that is reached by the waste powder when the waste powder that has piled up according to the first deposition profile substantially reaches the inlet.

* * * * *